US005289742A

United States Patent [19]

Vaughan, Jr.

[11] Patent Number: 5,289,742

[45] Date of Patent: Mar. 1, 1994

[54] VIBRATION DAMPING DEVICE FOR HAMMERS

[75] Inventor: Howard A. Vaughan, Jr., Lake Geneva, Wis.

[73] Assignee: Vaughan & Bushnell Manufacturing Co., Hebron, Ill.

[21] Appl. No.: 995,586

[22] Filed: Dec. 22, 1992

[51] Int. Cl.[5] ..... B25D 1/12

[52] U.S. Cl. ..... 81/22

[58] Field of Search ..... 81/20, 22

[56] References Cited

FOREIGN PATENT DOCUMENTS 628656 10/1961 Canada ..... 81/22

*Primary Examiner*—James G. Smith

*Attorney, Agent, or Firm*—Lackenbach Siegel Marzullo Aronson & Greenspan

[57] ABSTRACT

In a claw-type hammer, a shock-absorbing device is provided which includes an elongate elastic band or cord which captured within grooves of a hickory plug in regions which abut against internal surfaces of a socket into which the plug is press-fit. The plug is dimension and configurated in relation to the socket in the hammer head to provide at least some degrees of freedom of movement of portions of the elastic cord so that the elastic portions can vibrate or oscillate substantially independently of the natural oscillatory vibrations of the hammer head caused by impact. The tendency of the elastic cords is to at least to partially cancel or neutralize and, therefore, dampen the natural vibrations of the hammer head.

13 Claims, 1 Drawing Sheet

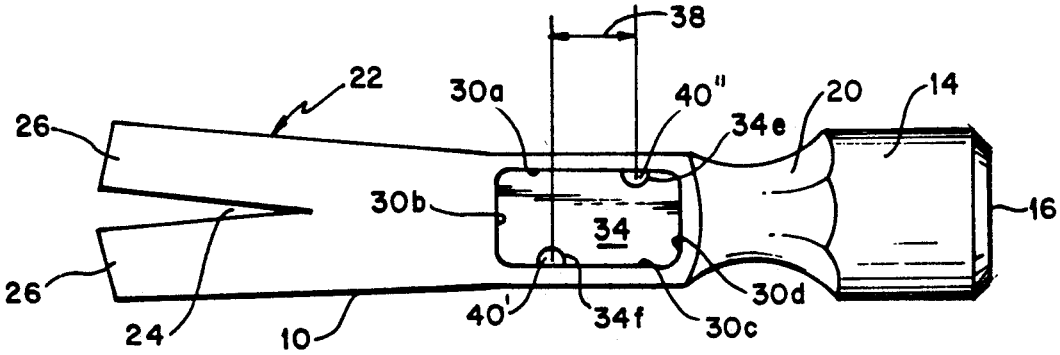
FIG. 1
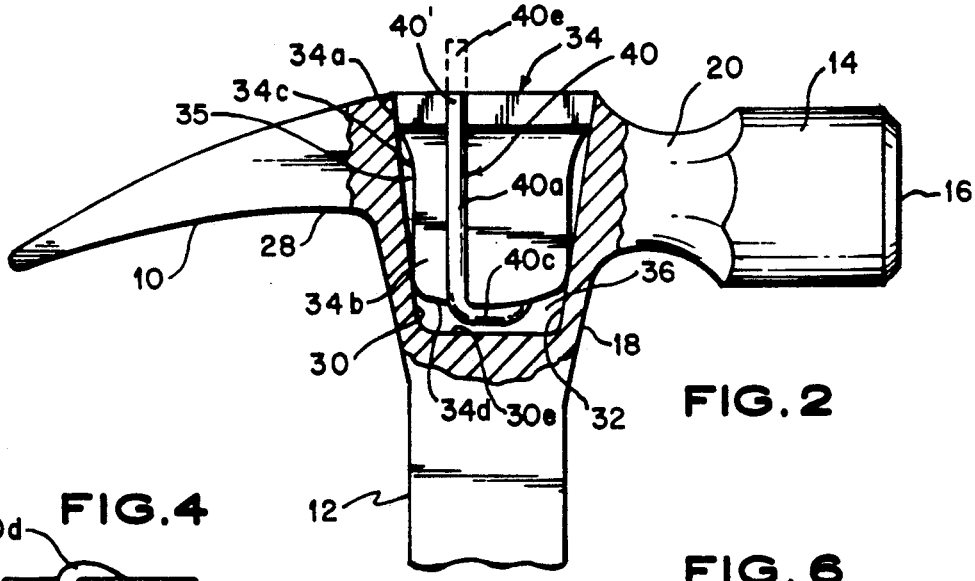
FIG. 2
FIG. 4
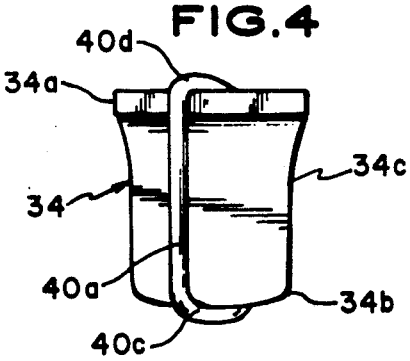
FIG. 6
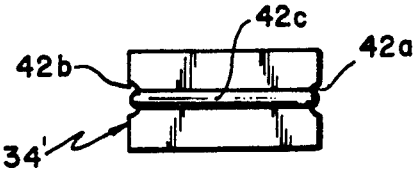
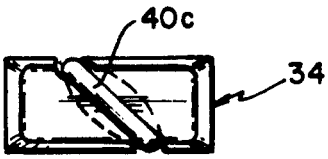
FIG. 3
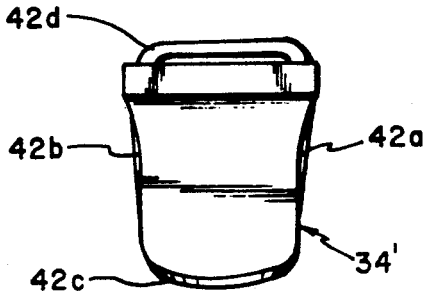
FIG. 5

VIBRATION DAMPING DEVICE FOR HAMMERS

BACKGROUND OF THE INVENTION

This invention relates to portable impact tools, and, more particularly, to a hammer construction which includes a vibration damping device.

The invention is specifically concerned with a forged carpenter's claw hammer of the so-called "indestructible" type wherein the striking head is formed integrally with a steel shank, the latter constituting a part of the hammer handle.

An indestructible hammer offers a few advantages over a conventional claw hammer of the hickory handle type, but is also possessed of numerous limitations. The advantages which make it popular are increased strength and a permanent union between the hammer head and the shank. In the case of a wooden handle type claw hammer having an impact head for nail-driving purposes and integral claws for nail-pulling or removing purposes, the hammer will ordinarily withstand even the roughest usage when put to the use for which it is intended. However, when it is put to unintended uses, as, for example, wrecking, will frequently be subject to handle breakage or looseness in the joint between the handle and the impact head. This is particularly true after the wooden handle has dried out, as it invariably will, in time. Such is not the case with an indestructible claw hammer having an integral steel shank. These factors are the reasons why such a hammer has met with appreciable success on the market.

On the other hand, indestructible hammers are possessed of numerous limitations, principal among which are: (1) lack of resiliency which renders it awkward in the hand of an experienced carpenter or workman, and (2) the tendency for impact to set up undesired vibrations.

Initially, indestructible type hammers were invariably in the form of a solid steel unit comprising a head, a pair of claws, and a shank. With such a hammer, the force of the impact is carried directly from the head into the shank where it is felt by the hand of the user. At the same time, a secondary and slightly out-of-phase impact is applied to the hand of the user by reason of the initial shock traveling across the head and into the claws which are caused to vibrate and send a secondary impact back into the shank following closely the initial and somewhat stronger impact force. Thus, the solid steel construction of an indestructible claw hammer does not afford significant shock-absorbing resiliency.

Such vibratory effects are not only annoying to the user of the hammer, but they weaken the hammer structurally so that, in time, cleavage or fracture takes place, usually in the vicinity of one or both of the claws. Cleavage has been known to take place directly across the base of a claw, not at a time when the claw is put to use in extracting a nail, but at a time when the claw portion of the hammer is not in use, the cleavage being complete and in the form of a clean fracture across the claw with the claw falling off or separating from the impact head.

In an effort to minimize such undesired vibrations, it is known to redistribute the metal of the impact head by forming therein a relatively deep rectangular socket, the socket extending crosswise of the head and in axial alignment with the shank and serving, in a measure, to divide the impact nose of the hammer head from the claw portion. The four side walls of the socket are relatively thin and much of the shock of impact is dissipated in these side walls. Furthermore, the socket is filled with a vibration dampening substance which further inhibits claw vibration. Such a hammer constitutes the subject matter of U.S. Pat. No. 2,884,969, granted on May 5, 1959 to Clarence M. Lay and entitled "Hammer Construction With Shock Absorbing Means." Reference to this patent reveals the fact that the provision of such a socket in the head of an indestructible type hammer affords advantages other than that of its vibration damping effect which are not, however, particularly relevant to the present invention which is concerned primarily with vibration damping.

A carpenter's claw hammer with vibration damping means is disclosed in U.S. Pat. No. 3,208,724 to Howard A. Vaughan. In order to attain a desired vibration damping effect, the disclosed hammer places ribs on the hammer head, the vibration damping ribs being provided on the inside surface of each claw and running from the base of the claw well into the medial region thereof. While such ribs may have an incidental function of strengthening or rigidifying the claws, they primarily function to inhibit claw vibration. The rectangular sockets in the medial body portion of the hammer is described as being preferably filled with a vibration damping substance, such as a suitable thermoplastic or thermosetting resin or, alternatively, may be filled with a wooden plug.

Rubber sleeves are interposed between the hammer shank and the head in U.S. Pat. No. 2,850,331 to John J. Curry for a handle connection for percussive tool. The resilient sleeve is provided to isolate the handle from vibrations set up in the tool during impact.

In U.S. Pat. No. 2,067,751 to Raymond E. Beegle for a securing means for tool handles and U.S. Pat. No. 2,917,349 to Charles Saylor for a tool handle connection with damp resilient bond, one or more layers or washers of a rubber-like material are provided between the head member and the handle portion to provide deformable shock-absorbent elements for damping vibrations of a head member so as to preclude production of destructive stresses therein.

While the foregoing hammer designs incorporate elements for damping or lessening vibrations following impact, the resilient elements normally interface between the hammer head and the handle. This, of course, means that all of the forces are transmitted through these resilient elements and, in time, these elements may deteriorate, losing their effectiveness and may create a hazardous joint between the handle and the hammer head. In the Vaughan Pat. No. 3,208,724, special ribs are used, and the resins or wooden plug filling the socket in the head become substantially integral with the head and form a single resonant system.

SUMMARY OF THE INVENTION

It is, therefore, the aim of the present invention further to reduce the principal cause of claw cleavage or fracture, namely, claw vibration, not only in an indestructible type claw hammer, whether solid or socketed, but also in a wooden handle hammer and in a tubular steel handle hammer where cleavage occasionally occurs for the same reason as outlined in connection with an indestructible type claw hammer.

This being the principal object of the invention, in furtherance thereof, it is contemplated that the forging of the hammer impact head be conducted as heretofore, whether in a socketed or a non-socketed indestructible type of claw hammer, or in a wooden or tubular steel handle claw hammer; that the conventional and prerequisite size, shape and weight of the hammer head be preserved substantially to the last detail so as to meet the rule of the experienced carpenter that the hammer head contain the proper amount of metal so that it will have the proper weight, have the proper balance, present an attractive appearance, and otherwise meet all of the requirements for a carpenter's claw hammer outlined in the above-mentioned patent.

BRIEF DESCRIPTION OF THE DRAWINGS

Other advantages and features of the invention are described with reference to exemplary embodiments, which are intended to explain and not to limit the invention, and are illustrated in the drawings in which:

FIG. 1 is a top plan view of a damping device in accordance with the present invention, shown incorporated in a carpenter's hammer;

FIG. 2 is a side elevational view of the hammer of FIG. 1, partially broken away to show how the damping device is seated in a socket in the medial body portion of the hammer head;

FIG. 3 is a side elevational view showing the vibration damping device of FIG. 2 before it is incorporated into the hammer;

FIG. 4 is a bottom plan view of the vibration damping device shown in FIGS. 1–3;

FIG. 5 is similar to FIG. 3 but showing a second embodiment of the vibration damping device of the invention; and FIG. 6 is a bottom plan view of the vibration damping device shown in FIG. 5.

DESCRIPTION OF THE PREFERRED EMBODIMENTS

Although specific embodiments of the invention will now be described with reference with the drawings, it should be understood that the embodiments shown are by of example only and are merely illustrative of the many possible specific embodiments which can incorporate the principles of the invention. Various changes and modifications, obvious to one skilled in the art to which the invention pertains, are deemed to be within the spirit, scope and contemplation of the invention as further defined in the appended claims.

Referring now to the drawing in detail and in particular to FIGS. 1–2 illustrating a carpenter's claw hammer of the indestructible type, the hammer head of the claw hammer of FIG. 1 is designated by the reference numeral 10. The head 10 is integrally formed with a shank 12 which constitutes a portion of the hammer handle. The head 10 illustrated is of the bell-face type and includes a cylindrical impact head portion 14 having a circular impact surface 16. However, other configurations of the head are within the scope of the invention.

The impact head portion 14 is connected to one side of the medial body portion 18 of the head by a constricted portion 20 which is polygonal in transverse section. The other side of the body portion 18 is connected to the claw region 22 of the head, such region is being bifurcated at 24 to provide the usual outwardly diverging claws 26. The base part of the claw region 22 merges with the body portion 18 of the head 10 along a gradually-formed curved surface 28 as is customary in the formation of these indestructible type hammers. The medial body portion 18 of the hammer head is formed with a relatively deep opening or socket 30 therein. The socket 30 is generally rectangular in cross section, as shown in FIGS. 1 and 2, and the four side walls **30*a*–30*d* (FIG. 1) thereof converge inwardly toward each other at the inner regions of the socket. The bottom wall 30*e* of the socket is slightly dished as shown at 32 in FIG. 2**.

In accordance with the present invention, there is provided a plug generally designated in FIGS. 1–4 by the reference numeral 34. The plug 34 is preferably a hickory plug which is generally rectangular in shape to conform to the shape of socket 30 so as to be receivable therein in a press-fit relationship. For this purpose, the plug 34 is advantageously provided with an outer enlarged end portion **34*a* which substantially conforms with the upper end of the socket 30, as viewed in FIG. 2, so that the end portion 34*a* can be forced into the socket 30 in press-fit abutment against the respective walls or surfaces 30*a*–30d of the socket. Similarly, the plug 34 has a lower end portion 34*b* which is likewise dimensioned to conform with the peripheral surface dimensions of the socket 30 at the lower end thereof, as viewed in FIG. 2**, so as to likewise be in press-fit relationship therewith.

Between the ends **34*a* and 34*b*, there is an intermediate plug portion 34*c* which is, optionally, inwardly bowed or recessed in relation to the walls or surfaces 30*a*–30*d*, as best shown in FIG. 2, so as to create at least one or more clearances or spaces 35**, for reasons which will become apparent.

As best shown in FIG. 2, the axial length of the plug 34 is preferably shorter than the depth of the socket 30 in the direction of the shank 12 so as to provide a clearance or space 36 between the lower surface **34*d* of the plug and the lower surface 30*e*** of the socket.

The plug 34 is provided with an elongate groove **34*e* within the end portion 34*a* preferably arranged so that at least a portion of the groove is open along or proximate to the wall 30*a* of the socket 30 when placed therein, as shown in FIG. 1. Similarly, an elongate groove 34*f* is provided in the upper portion 34*a* preferably arranged so that at least a portion of the groove is open along or proximate to the wall 30*c* when placed in the socket 30. Although not critical, the slots or grooves 34*e* and 34*f* are advantageously offset a distance 38 (FIG. 1**) along the striking direction of the hammer.

An elastic cord or band 40 is provided, the free ends of which 40', 40'' (FIG. 1) are respectively captured within the grooves or slots **34*e* and 34*f* as shown, the intermediate portion of the cord or band extending inwardly into the socket 30 and transversely extending across the innermost end of the plug 34, as best in shown in FIGS. 2 and 4. Thus, the cord or band 40 includes two substantially parallel longitudinal portions 40*a* and 40*b*, and a bridging portion 40*c* which traverses across the lower surface 34*d* of the plug. By compressing the free ends into at least partially open grooves, the resilient free ends come into contact with the walls 30*a*, 30*c*, securing the free ends and providing additional frictional resistance for preventing the inadvertent release of the plug 34 from the socket 30**.

The semi-rectangular socket 30 is typically filled with the hickory plug 34 which, if desired, may be covered by an outer veneer of plastic material.

As far as the shock-absorbing quality of the hammer is concerned, the four walls **30*a*–30*d* of the socket are of relatively thin construction, especially in the base region thereof. Thus, any impact shock which is applied to the hammer head impact surface will be transmitted through the reduced neck portion 20 to the relatively thin sidewalls 30***a*–30*d* of the socket. Much of this impact shock will be dissipated in these sidewalls and only a limited portion thereof will be conducted from the sidewalls to the shank portion 12. In the absence of the plug, a relatively small amount of vibration may be set up in the claw but the extent of such vibration will not be nearly as great as in the case of the indestructible hammer having a solid head without the rectangular socket. When the socket is filled with a plug or a vibration-damping substance, the duration of any harmonic vibrations set up in the claw region 22 will reduce this process, resembling damping the vibration of a tuning fork or a resonant bell when the hand is applied thereto. By such an arrangement, prolonged harmonic vibration of the claw region 22 is prevented. Furthermore, reduction in the vibrational effect of the claw portion 22 will materially reduce any secondary impact shock which may be transmitted from the claw to the shank 12.

The rubber or elastic elements 40*a*–40*c* which extend about the wooden plug 34, as shown in the figures, can move substantially independently of the hammer head and wooden plug. This is because the rubber material is sufficiently fluid that it can experience compressions, expansions and elongations, within the cavities or spaces 35, 36 through which it extends. This is particularly true with the sections 40*c*, 42*c* of the elastic at the lower ends of the plugs 34, 34', respectively, where the sections 40*c*, 42*c* of the elastic extend through the spaces 36 in which there is a clearance between the plug 34 and the hammer head inner most surface 30*e*. To the extent that sections 40*a*–40*c* of the elastic, therefore, can move independently of the hammer head and/or wooden plug, it can probably be said that such elastic sections define their own resonant bodies defining their own resonant frequencies which are a function of their own masses and their own configurations.

One possible theory as to why the use of such elastic element reduces vibrations of the overall hammer is that the vibrations of the elastic sections 40*a*–40*c* result in movements which convert kinetic energies of movement to heat, which is dissipated. By dissipating the energy in this manner, the vibrations of the hammer are dampened more quickly and are less noticeable to the user.

Also, because the hammer head is more rigid and has a much greater mass, it would normally have a higher frequency vibration curve which decays more slowly than the lower frequency vibration curve of the elastic element which has a much lower mass. However, regardless of the relative frequencies of vibrations, when the elastic elements vibrate with the same phase or sense (amplitude additive) as the hammer head and wooden plug, they act as a unit or vibrate in unison, thereby effectively retaining the overall vibration effect. However, when the elastic elements vibrate with opposite phase (amplitude subtractive) to the vibration of the hammer head and wooden plug, the effect is to reduce the amplitudes of the vibrations by at least partially canceling the vibrations of the hammer head. Therefore, even if the frequencies are different, the observed effective vibration amplitudes should decrease.

Naturally, the smaller the elastic elements 40 or the less mass that they contain, the less the effect that will be exhibited. Maximum energy dissipation and cancellations would appear to arise with maximum practical masses of the elastic. In order to maximize conversion of mechanical energy to heat, a material is selected for the element 40 which has high absorption properties. One example of such a material is butyl rubber, although other natural and synthetic materials may also be used.

In the presently preferred embodiment, the band or cord 40 preferably has a circular cross-section, although the specific cross-section of the band or cord is not critical. Advantageously, the cross-sectional dimensions of the band or cord 40 are greater than those of the grooves or channels 34*e* and 34*f* so that once these are force-fitted into those grooves or channels, the band becomes captured at its free ends 40', 40'' and secured to the plug.

While the height of the space 36, along the direction of the shank 12, is not critical, it is preferably selected to be greater than the diameter of the cord or band 40 so that the bridging portion 40*c* is not held in pressure relationship between the plug 34 and the surface 30*e* of the socket but is free to move. At least one of the segments or portions 40*a*–40*c* preferably has at least some degree of freedom for movement within the respective spaces 35, 36. Thus, the parallel segments or portions 40*a* and 40*b* should have some degree of freedom for movements within the spaces 35 while the segment or portion 40*c* should have some degree of movement within the space 36, as suggested in FIG. 4 by the dash outlines.

Referring to FIGS. 5 and 6, an alternate embodiment is shown wherein the segments or portions 42*a*, 42*b* extend along the other set of sides of the plug 34, so as to abut against walls or surfaces 30*b* and 30*d*, shown in FIG. 1. With this arrangement, therefore, the bridging segment or portion 42*c* extends substantially along the striking direction of the hammer head, as best shown in FIG. 6, instead of being arranged in an inclined direction relative to that striking direction, as shown in FIG. 4.

It will be appreciated that insertion of the plug 34 in pressure-type relationship within the socket 30 will substantially lock the plug 34 within that socket. To that extent, the plug 34 becomes rigidly associated with the hammer head 10 and becomes a part of it, although it may modify, the resonant or vibratory mass defined by the hammer head. Accordingly, the cord or band 40, and the respective portions 40*a*–40*c* thereof define their own vibratory systems which at least allow internal movements in the form of compressions and expansions within the spaces to which they are confined or in which they are locked. Impact with the hammer head 16, therefore, causes independent vibrations to be set up within the hammer head and plug, on the one hand, and the elastic cord or band 40, on the other hand. The resonant frequencies and amplitude of oscillations of the various band or cord portions 40*a*–40*c* will, of course, depend upon the dimensions of these portions as well as the specific materials from which they are made. However, it has been found that in many cases, these auxiliary vibration systems tend to lessen the adverse vibrations which result with standard hammer configurations.

Referring to FIGS. 3–6, the cords or bands 40, 42 may initially be formed as closed loops to facilitate assembly. Thus, the loops are placed about the plugs and forced into the sockets 30. Once the plugs are press-fit in the sockets, the exposed cord or band portions 40*d*, 42*d* can be cut off or ground off, after they are no longer needed to retain or support the cords about the plugs. However, the cords or bands 40,42 may be formed from elongate strips which are placed about the plug 34 as suggested in FIG. 2. The lengths of the elastic strips may be somewhat longer than required so that the free ends initially extend beyond the exposed surface of the plug, as suggested at 40*e* in FIG. 2, the free ends being made flush with the exposed surface of the plug during a finishing step of the hammer.

The invention is not to be limited to the exact arrangement of part shown in the accompanying drawings or described in the specification, as various changes in the details of constructions may be resorted to without departing from the spirit of the invention. Therefore, only insofar as the invention has been particularly pointed out in the accompanying claims is the same to be limited.

I claim:

1. A shock-absorbing device for a claw hammer or the like comprising:

an integral steel head and shank forming a handle, said steel head being formed with a medial body portion from which said shank extends outwardly, the medial body portion being formed with an elongated socket having an axis substantially in alignment with a longitudinal axis of said shank and wall surfaces defining said socket;

a vibration damping unit comprising a plug base member formed with a plurality of walls and having a hardness less than the hardness of said steel head, and an elongate resilient element having at least end portions, and having a hardness less than the hardness of said plug base member;

said plug base member being configurated and dimensioned to be receivable within said elongated socket in a press-fit relationship therewith and defining at least one clearance or space between said plug base member and said wall surfaces of said elongated socket, said resilient element being positioned in such a manner that in the assembled condition of said claw hammer when said plug base member is positioned within said elongated socket, at least said end portions of said resilient element are fixed relative to said steel head and base member; and said plug base member includes grooves formed within said plurality of walls for receiving at least a part of said resilient element, said portions of the resilient element extending at least about a part of an outside periphery of said plug base member;

whereby in use any harmonic vibrations set up at said steel head and transferred to said plug base member are interrupted and/or dampened by vibrations of said resilient element.

2. A shock-absorbing device for a claw hammer according to claim 1, wherein said plug base member is a hickory plug.

3. A shock-absorbing device for a claw hammer according to claim 2, wherein said socket is substantially rectangular and wherein said hickory plug is formed by front, rear, and two side walls, as well as top and bottom surfaces.

4. A shock-absorbing device for a claw hammer according to claim 3, wherein said base member includes grooves, for receiving at least portions of said resilient element, extending at least about a portion of the outside periphery thereof and said grooves are formed within said front and rear walls.

5. A shock-absorbing device for a claw hammer according to claim 4, wherein said grooves are offset from each other along the striking direction of said head.

6. A shock-absorbing device for a claw hammer according to claim 3, wherein said hickory plug includes grooves, for receiving at least portions of said resilient element, extending at least about a portion of the outside periphery thereof and said grooves are positioned within side walls of said hickory plug.

7. A shock-absorbing device for a claw hammer according to claim 6, wherein said grooves are offset from each other along the striking direction of said head.

8. A shock-absorbing device for a claw hammer according to claim 1, wherein said medial body portion has substantially flat sides, the side walls of said socket being relatively thin and substantially flexible to absorb a portion of the impact shock acting on the head.

9. A shock-absorbing device for a claw hammer according to claim 1, wherein said resilient element is formed of a material having relatively high vibration absorption properties.

10. A shock-absorbing device for a claw hammer according to claim 9, wherein said material comprises butyl rubber.

11. A shock-absorbing device for a claw hammer according to claim 1, wherein said resilient element has a bridging or intermediate portion at least partially extending into said clearance or space, so that said intermediate portion having an additional degree of freedom of movement relative to said head and said plug base member.

12. A shock-absorbing device for a claw hammer according to claim 3, wherein said grooves are formed within at least said front and rear walls.

13. A shock-absorbing device for a claw hammer according to claim 12, further comprising said groove being formed within said bottom surface of said hickory plug.

* * * * *